US007516713B1

(12) United States Patent
Franta

(10) Patent No.: US 7,516,713 B1
(45) Date of Patent: Apr. 14, 2009

(54) HURRICANE ANCHOR SYSTEM

(76) Inventor: John Eugene Franta, 3055 N. Red Mountain #95, Mesa, AZ (US) 85207-1055

( * ) Notice: Subject to any disclaimer, the term of this patent is extended or adjusted under 35 U.S.C. 154(b) by 0 days.

(21) Appl. No.: 12/002,931

(22) Filed: Dec. 19, 2007

Related U.S. Application Data

(60) Provisional application No. 60/875,602, filed on Dec. 19, 2006.

(51) Int. Cl.
*B63B 21/24* (2006.01)

(52) U.S. Cl. ..... 114/293; 114/230.26

(58) Field of Classification Search ..... 114/230.2, 114/230.24, 230.26, 230.27, 293, 294; 59/85, 59/86; 405/224; 441/3, 5
See application file for complete search history.

(56) References Cited

U.S. PATENT DOCUMENTS 3,817,028 A 6/1974 Blackwood
3,962,811 A 6/1976 Buschini et al.
4,561,797 A * 12/1985 Aldridge ..... 59/86
4,836,813 A 6/1989 Poldervaart
5,212,939 A 5/1993 Pratt, Jr.
6,216,628 B1 4/2001 Poldervaart
6,357,378 B1 * 3/2002 Hile ..... 114/230.2
6,439,149 B1 * 8/2002 Hile ..... 114/294
6,532,885 B1 3/2003 Cordoba
6,810,826 B1 11/2004 Bellis, Jr.
7,383,785 B1 * 6/2008 Schmidt et al. ..... 114/230.2
7,455,025 B1 * 11/2008 Franta ..... 114/230.26

OTHER PUBLICATIONS

Charles E. Kanter, How to Create an Instant Hurrican Mooring, www.southwindsailing.com/articles/9906/InstantHarbor.shtml; Jun. 1999.

* cited by examiner

*Primary Examiner*—Lars A Olson
(74) *Attorney, Agent, or Firm*—Ronald R. Kilponen

(57) ABSTRACT

An anchor system 12 is shown and described. The anchor system 12 consists of a boat plate 18 to which are rotatably attached a plurality of boat shackles 24. The boat shackles 24 are affixed to boat lines 14 that secure the boat B to the boat plate 18. The boat plate 18 is attached with a swivel 22 to an anchor plate 20. The anchor plate has a plurality of anchor shackles 26 to which are attached anchor lines 16. The anchor lines 16 are then attached to anchors which are secured to the sea or lake bed. This anchor system 12 can be used to secure a boat B in a harbor or in the water to the sea or lake bed. The system as described helps prevent the boat lines 14 or the anchor lines 16 from crossing over one another during undesirable weather thus helping to prevent chafing and premature line failure. This system can help prevent failure of the lines 14, 16 and boat loss or catastrophic damage to the boat B.

6 Claims, 7 Drawing Sheets

HURRICANE ANCHOR SYSTEM

CROSS REFERENCE TO RELATED APPLICATIONS

This application claims the benefit of Provisional application for Patent Ser. No. 60/875,602 filed on Dec. 19, 2006.

FIELD

The present version of these embodiments relates generally to the field of Anchoring Systems for vessels, more specifically to those vessels that by choice or necessity are anchored in the water to the sea or lake bed during rough or inclement weather. The present version of the embodiments can also be used for mooring a floating vessel in the water to the sea or lake bed.

BACKGROUND

This invention relates to devices used to moor vessels in the water and more particularly to an anchoring system that can decrease the likelihood of a vessel becoming loose during inclement weather or normal weather. Water sportsmen enjoy spending time on the water and on their vessels. Unfortunately they have not found a way to change the weather such that they are not in bad weather while on their vessels or in a harbor. Bad weather can and does cause significant damage to vessels whether the vessels are in a harbor, in the water or stored on land.

When a storm is approaching and a boater wants to secure a boat or vessel, they typically point the bow of the vessel into the anticipated oncoming winds and then use one or more anchors to secure the vessel to the sea or lake bed of the body of water or harbor. The boater then runs one line from each of the separate anchors to the vessel. This set up can result in the crossing over of these anchor lines securing the individual anchors to the vessel. The cross over of anchor lines can result in chafing and wear of the lines causing the lines to prematurely fail. If this occurs during inclement weather this can result in the loss of the vessel, damage to other nearby vessels, or damage from the vessel grounding or being pounded against the shore. The methods shown in the background art do not allow for the even distribution of the load between the lines and the anchors nor do they discourage the crossing and chafing of the lines.

Many boaters use multiple lines from their vessel to a mooring ball or to a single anchor. Sometimes they use chains, which don't provide any flex, or use multiple lines to the vessel or multiple lines to multiple anchors. Multiple lines used in this manner increases the chances that the lines will get crossed and chafing of the lines will occur as the vessel is moved about by inclement or normal weather. When the lines get chafed, they begin to lose strength and this increases the chances that a premature failure will occur to one or both lines with significant monetary losses to the vessel owner. The lines can cross at the anchors, mooring balls or at the vessel where they are attached.

There is a need to have a device that would allow multiple redundant lines to both the anchors and to the vessel. This device should minimize the possibility of the lines crossing over one another such that they do not chafe and fail. This device should be strong enough to withstand the forces put on it by the combined forces of the vessel being moored and the force of the waves and wind on the vessel. This device should be relatively easy to install and provide multiple options for attaching anchors and lines to the vessel.

This device can decrease the likelihood of damage to a vessel if the owner needs to keep it moored in a harbor or in the water to the sea or lake bed. Generally redundancy is the key to having a safe and successful marine outing. This device provides multiple attachments to both the anchors and the vessel. These multiple attachments are arranged to minimize the possibility of the lines crossing, chafing against one another and failing. The use of multiple lines allows the placement of multiple anchors. These anchors can be optimally placed depending upon the direction of the offending weather, harbor conditions and other variables. Multiple lines to the vessel likewise allows the optimal placement of the lines to the vessel. Because the lines stay separated, the likelihood of crossing and chafing is minimized and the vessel is more likely to remain in the water throughout the inclement weather and not become loose from the sea or lake bed preventing damage from free floating, other vessels or becoming beached on the shore.

For the foregoing reasons, there is a need for a device that will allow multiple lines to multiple anchors and multiple lines to the vessel while minimizing the possibility that the lines will cross, chafe and prematurely fail.

SUMMARY

In view of the foregoing disadvantages inherent in the background art for mooring or attaching boats or ships to multiple anchors there is a need for a Hurricane Anchor System that can accommodate redundant lines and that minimizes many of the shortcomings of the methods or products used in the background art.

A first objective of the embodiments is to provide a device that can help secure boats or ships to anchors. Another objective of the embodiments is to provide a device that can help eliminate premature failure of anchor lines. It is yet another objective of the embodiments to provide a device that can help even out the tension on anchor lines. It is a still further objective of the embodiments that can allow the use of redundant anchor lines from the anchors to the ship or boat.

These together with other objectives of these embodiments, along with various features of novelty which characterize these embodiments, are pointed out with particularity herein. For a better understanding of these embodiments, the operating advantages and the specific objectives attained by its uses, reference should be had to the accompanying drawings and descriptive matter in which there is illustrated a preferred embodiment of the hurricane anchor system.

DETAILED DESCRIPTION OF THE PREFERRED EMBODIMENTS

Figure 1:
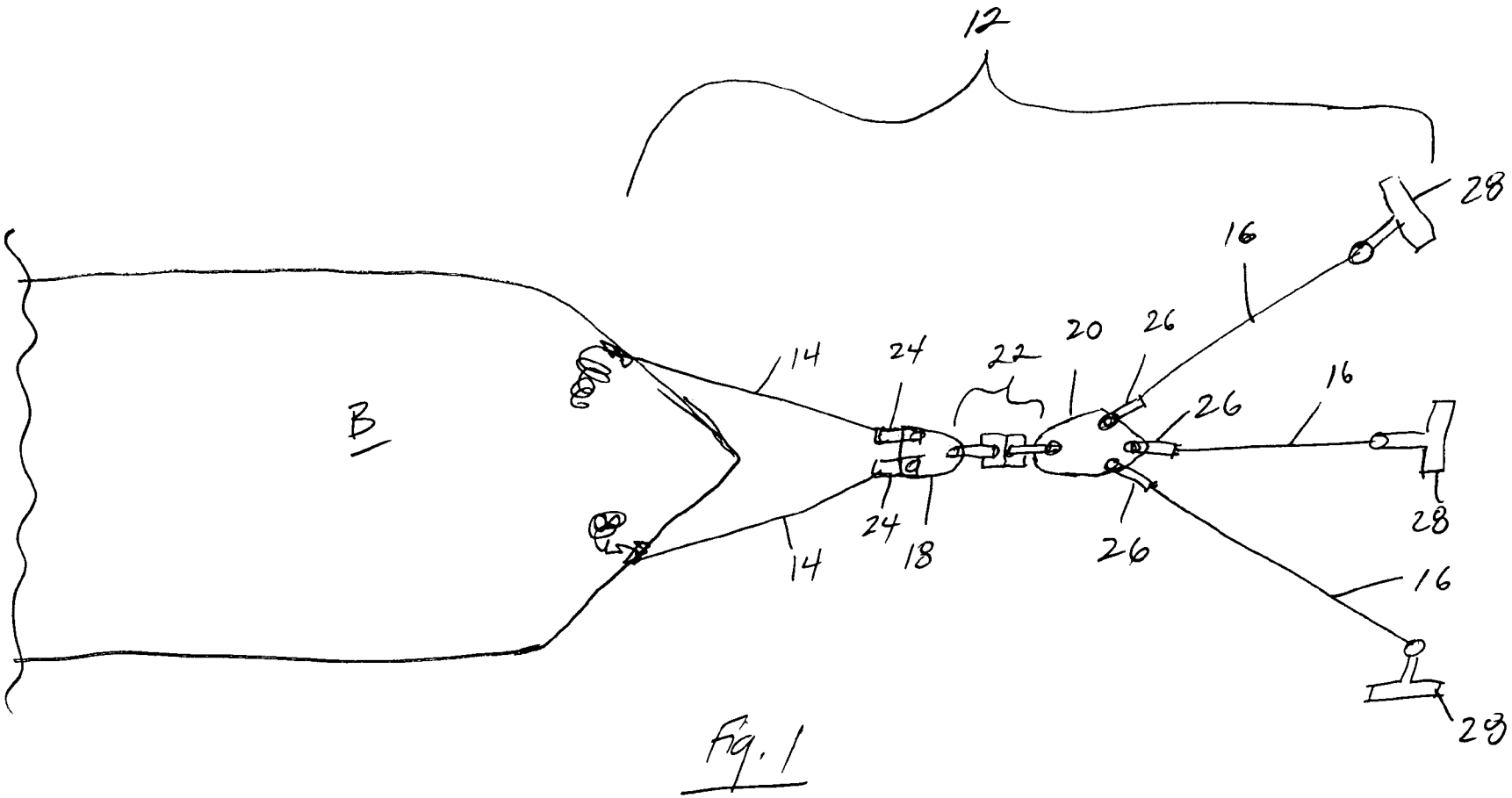
FIG. 1 shows a top view of one version of the embodiments affixed to a mono-hull boat.
Figure 2:
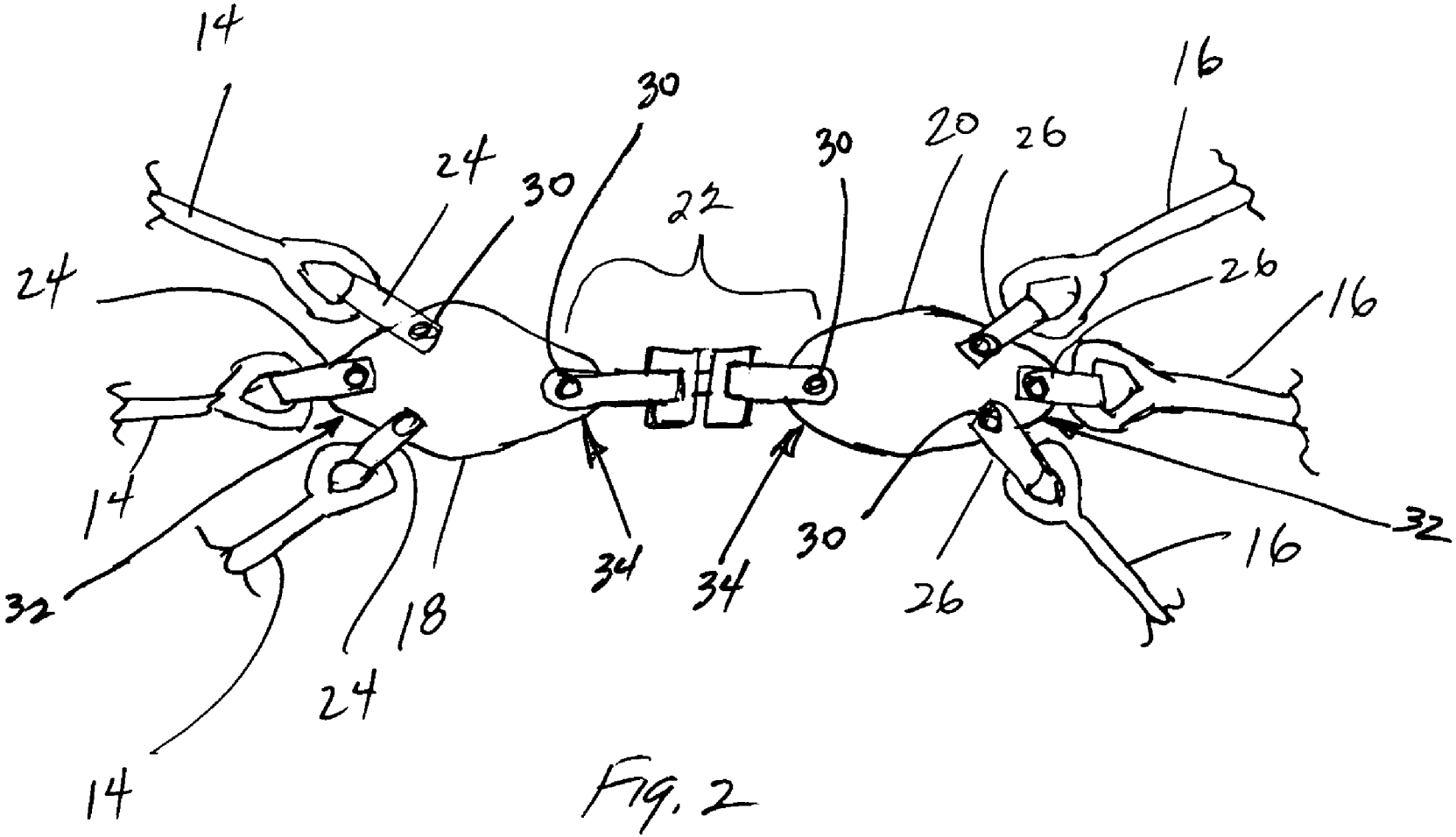
FIG. 2 shows a top view of a multi-hull version of the embodiments.

Referring to the drawings in detail wherein like elements are indicated by like numerals, there is shown in FIG. 1 one embodiment of the hurricane anchor system 12 attached to a mono-hull boat B. The hurricane anchor system 12 has three main elements. The first is the boat plate 18. In FIG. 1, the boat plate 18 has two boat shackles 24 which are rotatably affixed to the boat plate 18 with pins through holes 30 in the first end 32 of boat plate 18. To the shackles 24 are attached boat lines 14 which are then attached to the boat B a various user chosen attachment points. While this embodiment shows a mono-hull boat B, FIG. 2 shows a boat plate 18 with three shackles 24 attached to three boat lines 14 which are to be attached to a multi-hull boat (not shown) at various user chosen attachment points. It should be appreciated and understood that the version of these embodiments with two boat lines 14 could also be used for a multi-hull vessel.

Figure 3:
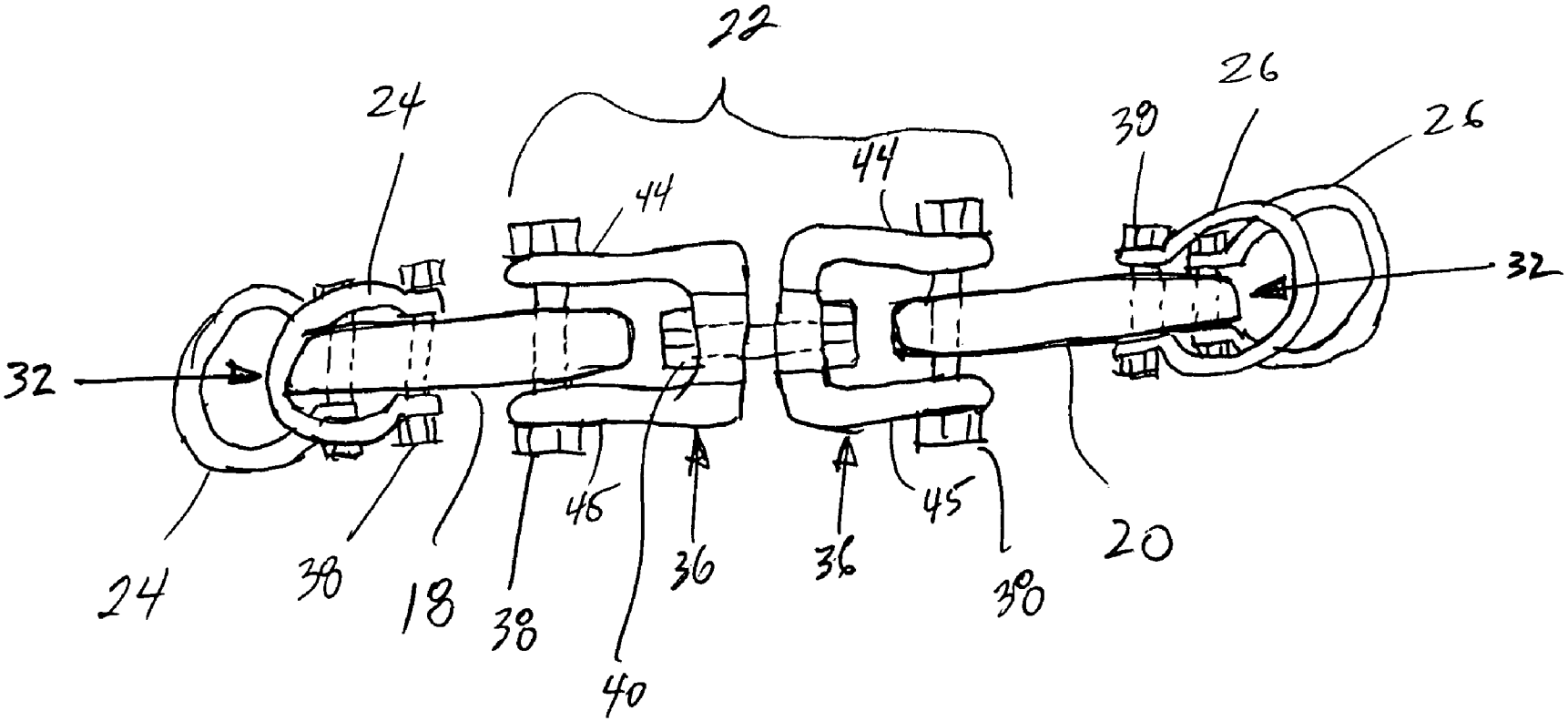
FIG. 3 shows a side view of one version of the embodiments.

The boat plate 18 has a hole 30 at the second end 34 attached to a swivel 22, best shown in FIGS. 2, 3. The swivel 22 is assembled from two yokes 36, FIG. 4. The yokes 36 are rotatably attached to one another with a bolt 40. The bolt 40 is attached so that the yokes 36 can rotate relative to one another around bolt 40. One yoke 36 has a pin 38 passing through the first arm 44 through a hole 30 in the second end 34 of boat plate 18 and is secured in the second arm 45. Likewise, the other yoke 36 has a pin 38 passing through the first arm 44 through a hole 30 in the second end 34 of an anchor plate 20 and secured in the second arm 45, FIGS. 2, 3, 4. This thus secures the boat plate 18 to the swivel 22 and swivel 22 to the anchor plate 20.

FIG. 2 shows a multi-hull boat plate 18 having three boat shackles 24 attached to holes 30 in the first end 32 of the boat plate 18 and three boat lines 14 attached to the boat shackles 24. The boat shackles 24 can rotate relative to the boat plate 18 and independently of one another. The boat lines 14 would then be attached to the boat, for this embodiment, a multi-hull boat (not shown). While three boat lines 14 are shown it should be understood and appreciated that the boat lines could also be used to attach a mono hull vessel also.

The swivel 22 is likewise attached to hole 30 in the second end 34 of the anchor plate 20 which has three anchor shackles 26 attached to holes 30 in the first end 32 of the anchor plate 20. The anchor shackles 26 can rotate relative to the anchor plate 20 and independently of one another. To the anchor shackles 26 in this embodiment are attached three anchor lines 16. The anchor lines 16 can then be attached to anchors 28 as shown in FIG. 1.

If a storm is approaching and a boat B is in a harbor the owner can then fix three anchors 28 at various angles relative to one another, with various lengths of anchor line 16. The boat B is generally pointed into the direction of the anticipated oncoming winds. The anchors 28 can then be spread at various angles and with various lengths of anchor line 16. The boat lines 14 are then affixed to the boat B.

This anchor system 12 separates the anchor lines 16 and keeps them from crossing over one another, chafing and lessens the likelihood of line failure. Likewise, the boat lines 14 are separated from one another and prevented from crossing over one another, chafing and possibly failing. The boat shackles 24 allow the boat lines 14 to move relative to one another. Likewise, the anchor shackles 26 allow the anchor lines 16 to move relative to one another. The swivel 22 allows the boat plate 18 to rotate relative to the anchor plate 20. This allows the boat B to move up and down and side to side depending upon the weather and waves while lessening the likelihood of the boat lines 14 or anchor lines 16 will be crossing one another, chafing and failing.

Figure 4:
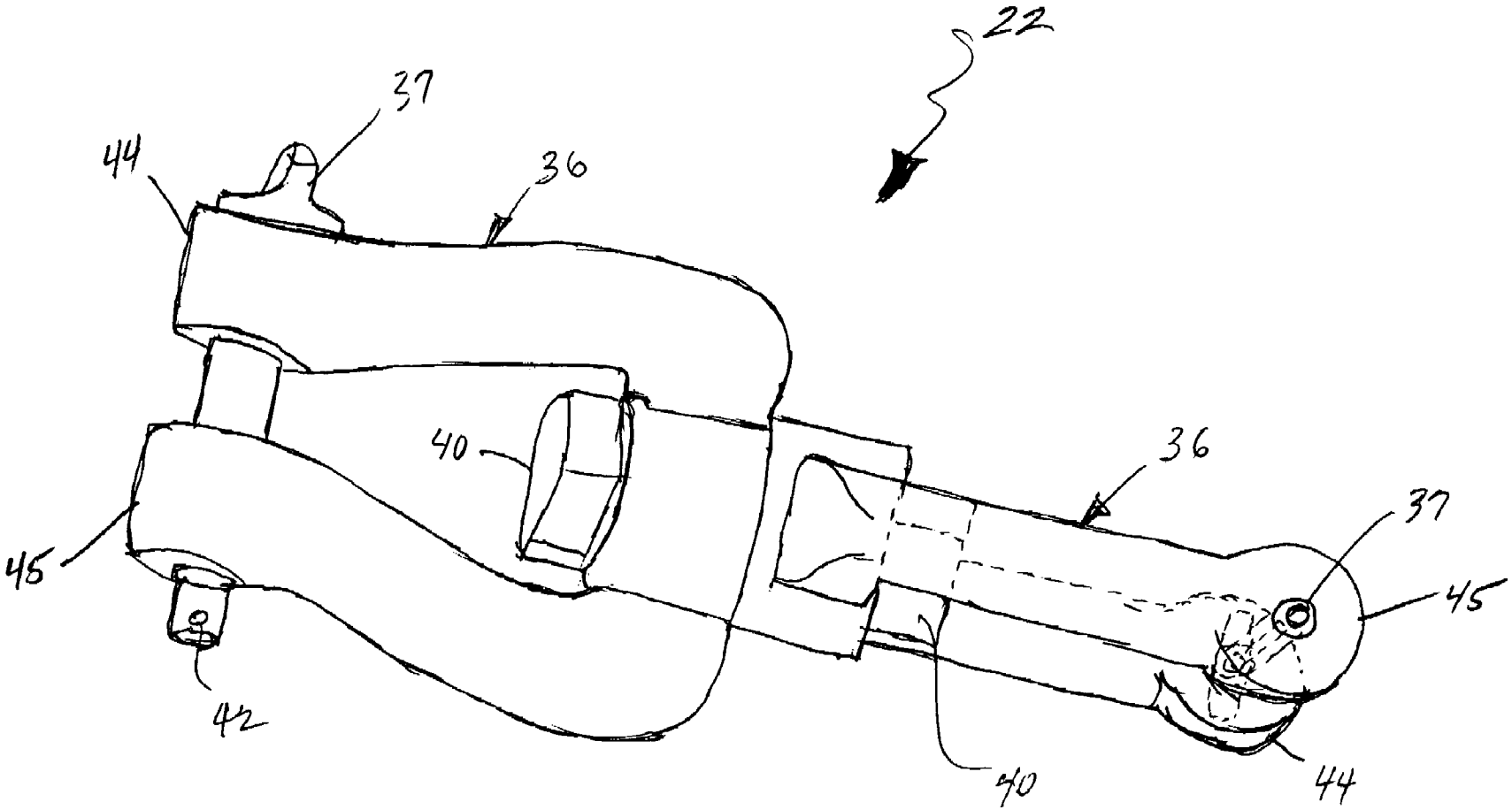
FIG. 4 shows a perspective view of one version of the swivel.
Figure 5:
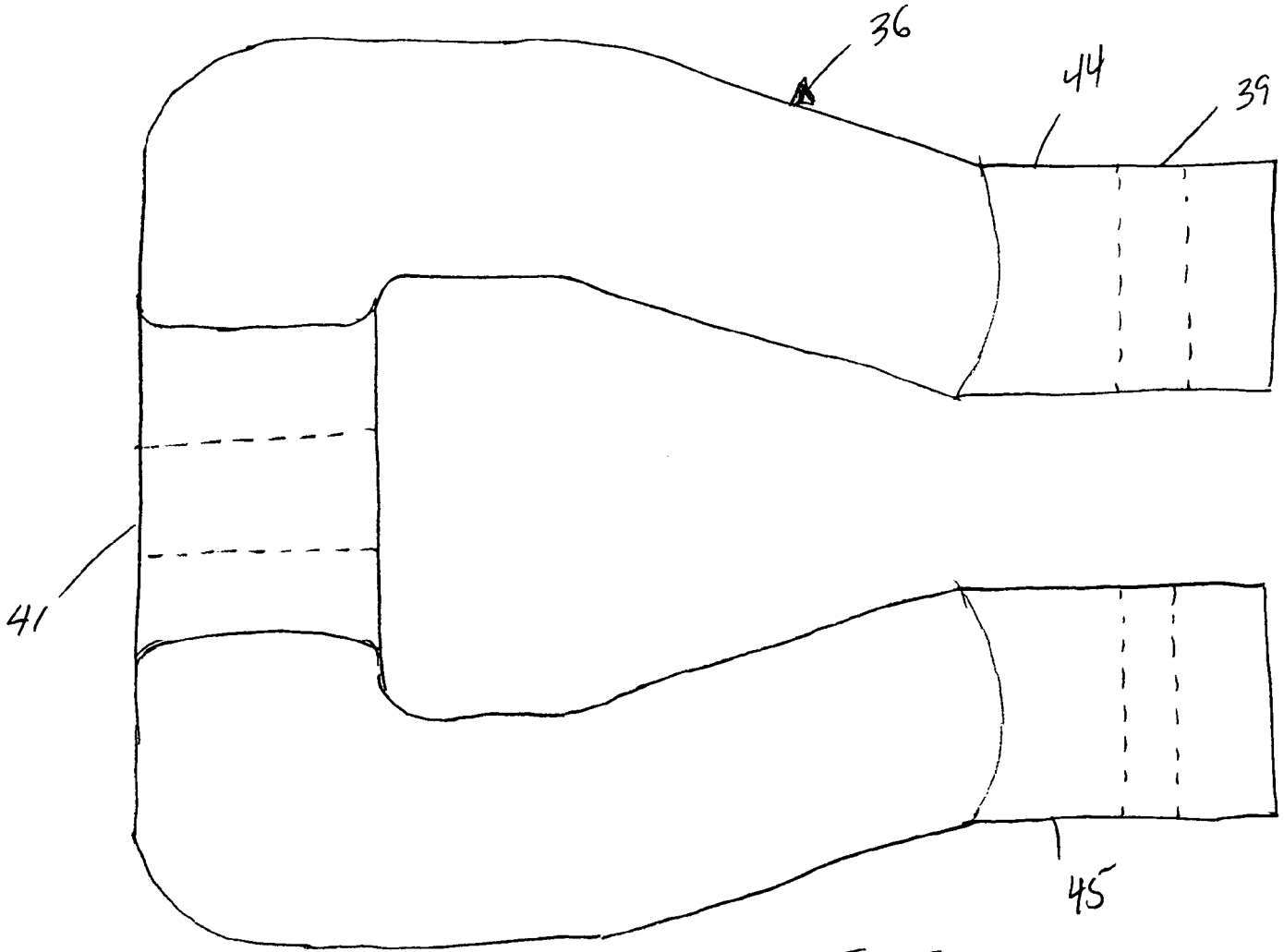
FIG. 5 shows a detailed view of one version of the yoke.
Figure 6:
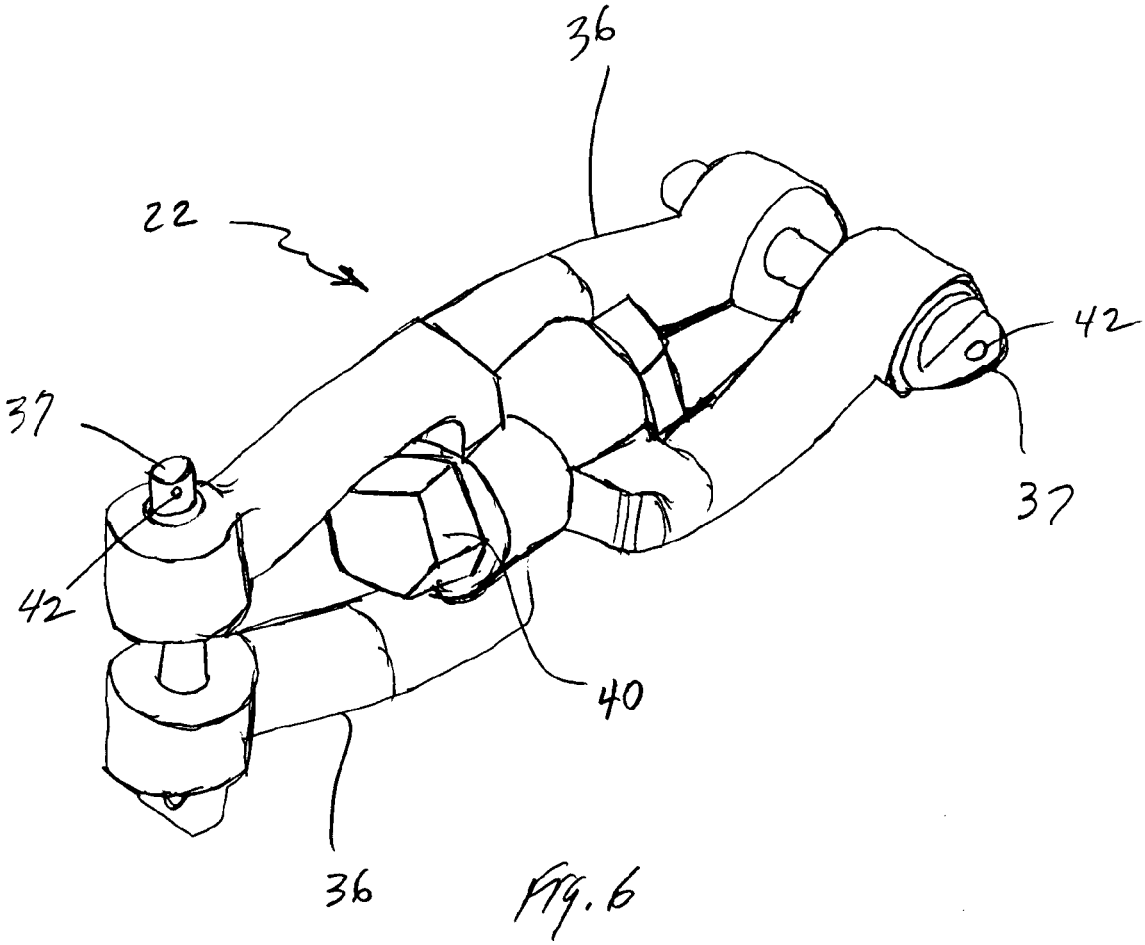
FIG. 6 shows a detailed perspective view of one version of the swivel with safety pins.

FIG. 5 shows a detailed side view of embodiment of the yoke 36. The yoke 36 has a first arm 44 and a second arm 45. Each of the arms 44, 45 have a pin hole 39 through which the pin 38 secures the yoke 36 to either the anchor plate 20 or the boat plate 18. The pin 38 can be a standard bolt and nut as shown in FIG. 3 or a safety pin 37 as shown in FIG. 4, 6. The safety pin 37 has a safety hole 42 in one or both ends. The safety holes 42 can have inserted through them cotter pins, wire or other methods (not shown) to help prevent the safety pins 37 from prematurely releasing from either the boat plate 18 or the anchor plate 20.

Figure 7:
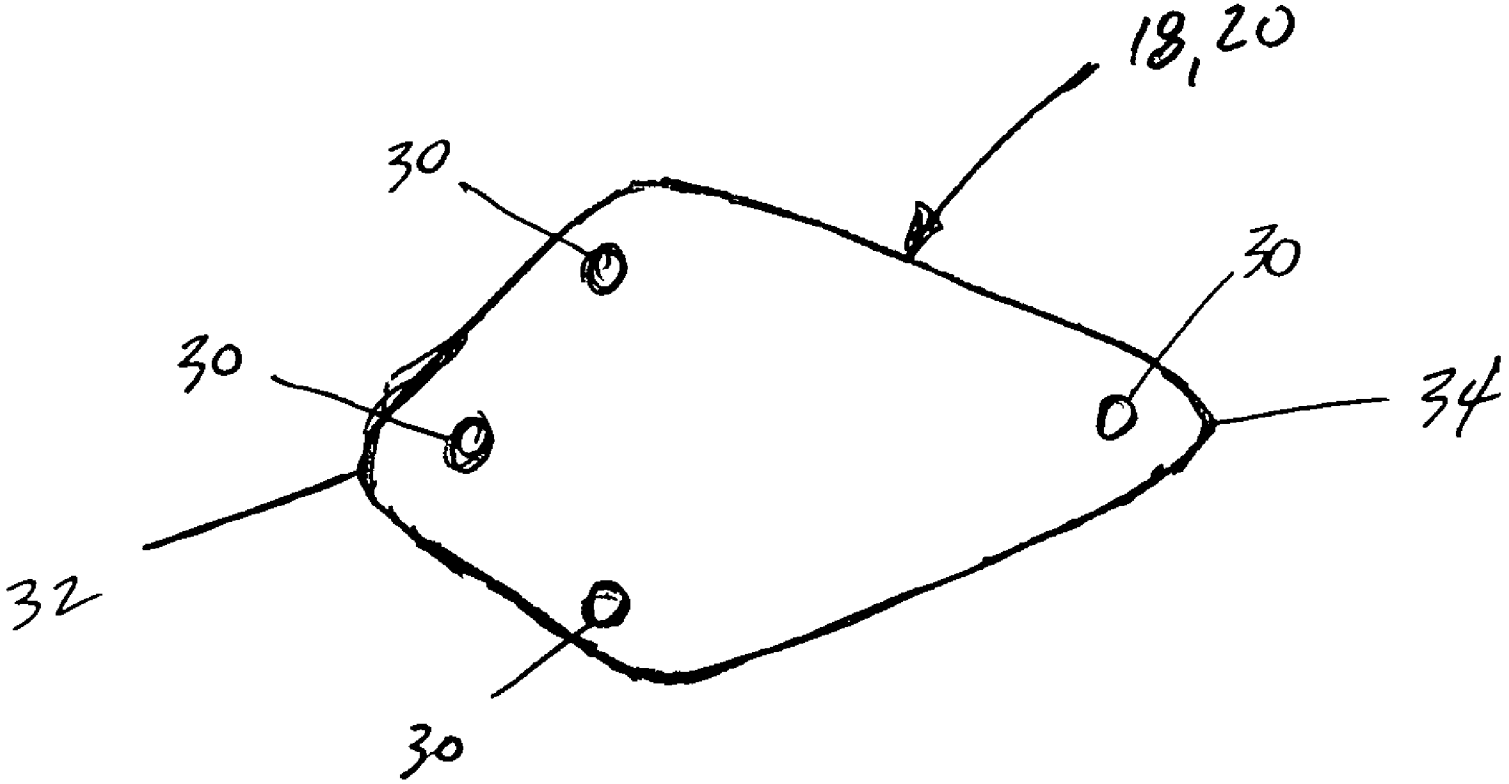
FIG. 7 shows one embodiment of the anchor and boat plate.

In FIG. 7 the relative locations of the holes 30 in the first end 32 of one embodiment are shown. It should be appreciated that the boat plate 18 and anchor plate 20 are mirror images of one another in the embodiment designed for three lines to the floating vessel and three lines to the anchors.

The locations of the holes 30 are placed a pre-determined distance apart and at pre-determined angles relative to the first end 32. These distances and angles are determined by the diameter of the boat and anchor lines 14, 16 (not shown). These different distances and angles are necessary such that the boat and anchor shackles 24, 26 and boat and anchor lines 14, 16 do not contact one another when the anchor system 12 is in use. Larger diameter lines require larger shackles therefor the distances and angles of these holes would vary dependent upon the design parameters of the anchor system 12.

The other embodiments designed for two lines to the floating vessel also have predetermined distances and angles for the holes 30 in the first end 32 dependent upon the system design parameters.

It will now be apparent to those skilled in the art that other embodiments, improvements, details and uses can be made consistent with the letter and spirit of the foregoing disclosure and within the scope of this application.

The invention claimed is:

1. A device for retaining a floating vessel in water to anchors secured to a sea or lake bed, the device comprising:

a boat plate, the boat plate having a plurality of holes in a first end and at least one hole in a second end, boat shackles removably affixed to the holes in the first end;

a swivel, the swivel having a first U-shaped yoke attached to a second U-shaped yoke with a bolt;

an anchor plate, the anchor plate having a plurality of holes in a first end and at least one hole in a second end, anchor shackles removably affixed to the holes in the first end;

a pin for attaching the first yoke of the swivel to the boat plate and a pin for attaching the second yoke of the swivel to the anchor plate; and whereby boat lines are attached from the floating vessel to the boat shackles and anchor lines are attached from the anchor shackles to the anchors and the floating vessel can be secured in the water to the sea or lake bed.

2. The pins of claim 1 further comprising:

the pins are safety pins having a safety hole for the attachment of a cotter pin or wire seizing.

3. A device for retaining a floating vessel in water to anchors secured to a sea or lake bed, the device comprising:

a swivel, the swivel having a U-shaped first yoke attached to a bolt, the bolt attached to a second U-shaped yoke, the first yoke attached with a pin to a second end of a boat plate the second yoke attached with a pin to a second end of an anchor plate;

the boat plate having a plurality of holes in a first end, boat shackles attached to the holes in the first end with pins and boat lines attached from the boat shackles to the vessel;

the anchor plate having a plurality of holes in a first end, anchor shackles attached to the holes in the first end with pins and anchor lines attached from the anchor shackles to anchors; and whereby the anchors can be set in the sea or lake bed and the floating vessel secured in the water.

4. The pins of claim 3 further comprising:

the pins are safety pins having a safety hole for the attachment of a cotter pin or wire seizing.

5. A device for retaining a floating vessel in water with anchors to a sea or lake bed, the device comprising:

a plurality of boat lines affixed to the vessel, the boat lines attached to a plurality of boat shackles, a boat plate with holes in a first end, the boat shackles attached with pins through the holes in the first end of the boat plate, a second end of the boat plate having a hole, the hole attached to a pin of a first yoke, the first yoke attached with a bolt to a second yoke, the second yoke attached with a pin in a hole in a second end of an anchor plate, a first end of the anchor plate having a plurality of holes, anchor shackles attached with pins to the holes in the first end, the anchor shackles attached to a corresponding number of anchor lines, the anchor lines attached to anchors which are secured to the lake or sea bed thereby securing the vessel to the sea or lake bed.

6. The pins of claim 5 further comprising:

the pins are safety pins having a safety hole for the attachment of a cotter pin or wire seizing.

* * * * *